US006945263B2

(12) United States Patent
Li et al.

(10) Patent No.: US 6,945,263 B2
(45) Date of Patent: Sep. 20, 2005

(54) OPERATION DEVICE FOR OUTDOOR UMBRELLA

(76) Inventors: Wanda Yiing Li, 2 Flagstone #642, Irvine, CA (US) 92606; Raymond J. Carabotta, 3466 N. Miami Ave., Miami, FL (US) 33127

( * ) Notice: Subject to any disclaimer, the term of this patent is extended or adjusted under 35 U.S.C. 154(b) by 0 days.

(21) Appl. No.: 09/798,686

(22) Filed: Mar. 2, 2001

(65) Prior Publication Data

US 2002/0121297 A1 Sep. 5, 2002

(51) Int. Cl.[7] ..... A45B 11/00

(52) U.S. Cl. ..... 135/20.1; 135/20.3; 135/28; 135/42

(58) Field of Search ..... 135/96, 97, 98, 135/121, 114, 115, 117, 120.1, 120.2, 38, 39, 40, 41, 28, 21, 20.3, 37, 20.1, 42, 43; 403/108; 285/303

(56) References Cited

U.S. PATENT DOCUMENTS

| | | | | | |
|---|---|---|---|---|---|
| 166,980 | A | * | 8/1875 | Francis | 135/41 |
| 631,442 | A | * | 8/1899 | Rose | 135/41 |
| 846,389 | A | * | 3/1907 | Blackburn | 403/108 |
| 1,223,833 | A | * | 4/1917 | Robbins | 403/108 |
| 3,446,523 | A | * | 5/1969 | Little | 135/114 |
| 4,135,835 | A | * | 1/1979 | Kitchen et al. | 135/120.2 |
| 4,586,525 | A | * | 5/1986 | Glatz et al. | 135/20.1 |
| 5,284,171 | A | * | 2/1994 | Liu | 135/20.3 |
| 5,437,297 | A | * | 8/1995 | Crisman et al. | 135/20.1 |
| 5,937,882 | A | * | 8/1999 | Harbaugh | 135/20.3 |
| 5,960,806 | A | * | 10/1999 | Steiner | 135/20.1 |
| 6,196,242 | B1 | * | 3/2001 | Xu | 135/20.1 |

FOREIGN PATENT DOCUMENTS

| | | | | |
|---|---|---|---|---|
| EP | 252192 A1 | * | 1/1988 | 135/24 |
| JP | 08056725 A | * | 3/1996 | |

* cited by examiner

*Primary Examiner*—Lanna Mai
(74) *Attorney, Agent, or Firm*—Raymond Y. Chan; David and Raymond

(57) ABSTRACT

An outdoor umbrella includes an operation device including a ring-shaped slider joint slidably connected to a shaft of the outdoor umbrella in a vertical movable manner, a locking stopper fitted in a locker hole of the shaft in an inwardly movable manner, a resilient unit for applying an urging pressure against the locking stopper to normally urge and retain the locking stopper extending into the locker hole so as to lock up the slider joint on the shaft, and a handle device for driving the locking stopper in an outwardly movable manner to move away from the locker hole so as to unlock the slider joint from the shaft.

9 Claims, 4 Drawing Sheets

OPERATION DEVICE FOR OUTDOOR UMBRELLA

BACKGROUND OF THE PRESENT INVENTION

1. Field of Invention

The present invention relates to an outdoor umbrella, and more particularly to an operation device for outdoor umbrella wherein the operation device is adapted for securely locking up the outdoor umbrella in an unfolded position, which prevent the children to operate the outdoor umbrella so as to guarantee the safety of children. Thus, the operation device can prevent the outdoor umbrella from being accidentally or unintentionally unfolded by the adults.

2. Description of Related Arts

A conventional outdoor umbrella comprises a supporting frame comprising a stand having a predetermined weight and a shaft upwardly extended from the stand, and a foldable awning supported by the supporting frame for providing a shading area.

From sunrise to sunset, the sunlight fell on the ground keeps changing at the time. In order to obtain the optimum shade from the outdoor umbrella, a user has to move the entire outdoor umbrella back and forth. Due to the weight of the stand, which is approximately 50 to 60 bounds, the user always has difficulty to move the outdoor umbrella.

An improved outdoor umbrella comprises a shaft rotatably extended for the stand wherein the shaft is arranged to rotatably drive the foldable awning to provide a better shading angle thereof. In order to extend the outdoor umbrella, both the processes of extending the foldable awning and unfolding the awning fabric must be operated at the same time, which is a hassle for the user.

In the extending process of the outdoor umbrella, the user may merely apply a relative larger extending force on the foldable awning in order to unfold the foldable awning wherein the extending force will be exerted on a pulley cord of the pulley system so as to stretch the pulley cord. It is dangerous when the pulley cord is broken by the extending force, the foldable awning may fall down accidentally, especially when a young child sits closed to the outdoor umbrella, so as to cause an unwanted injury to the young child.

SUMMARY OF THE PRESENT INVENTION

A main object of the present invention is to provide an operation device for outdoor umbrella for securely locking up an awning of the outdoor umbrella in an unfolded position so as to prevent the awning from being folded accidentally.

Another object of the present invention is to provide an operation device for outdoor umbrella for preventing under age children to operate the outdoor umbrella.

Another object of the present invention is to provide an operation device for outdoor umbrella wherein the operation device is performed individually such that an extending force from an awning frame will not exerted on a lift cord of a pulley system so as to prolong the service life span of the outdoor umbrella.

Another object of the present invention is to provide an operation device for outdoor umbrella wherein the operation device comprises a hand bar detachably mounted on outdoor umbrella in such a manner that once the outdoor umbrella is unfolded, the hand bar is adapted for being detached from the outdoor umbrella for safety purpose.

Another object of the present invention is to provide an operation device for outdoor umbrella wherein the unfolding operation of awning and the rotating operation of the shaft can be preformed individually for easy manipulation.

Another object of the present invention is to provide an operation device for outdoor umbrella, which does not require to alter the original structural design of the outdoor umbrella, so a to minimize the manufacturing cost of incorporating the operation device with every conventional outdoor umbrella having a shaft.

Accordingly, in order to accomplish the above objects, the present invention provides an operation device for outdoor umbrella wherein the outdoor umbrella comprises:

a stand, a rotatable shaft uprightly extended from the stand wherein a locker hole is transversely provided on an outer surface of the shaft, a foldable awning frame supported a fabric thereon comprising a first supporting arm extended to a top of the shaft and a second supporting arm pivotally connected to the first supporting arm and arranged in such a manner that when the second supporting arm pivotally rotates toward to the first supporting arm, the foldable awning frame is unfoldably extending;

a pulley system mounted on the shaft for folding and unfolding the fabric; and an operation device comprising a ring-shaped slider joint slidably connected to the shaft in a vertical movable manner wherein the second supporting arm of the foldable awning frame is pivotally connected to the slider joint, a locking stopper fitted in the locker hole of the shaft in an inwardly movable manner, a resilient element unit for applying an urging pressure against the locking stopper to normally urge and retain the locking stopper extending into the locker hole so as to lock up the slider joint on the shaft, and a handle means for driving the locking stopper in an outwardly movable manner to move away from the locker hole so as to unlock the slider joint from the shaft.

DETAILED DESCRIPTION OF THE PREFERRED EMBODIMENT

Figure 1:
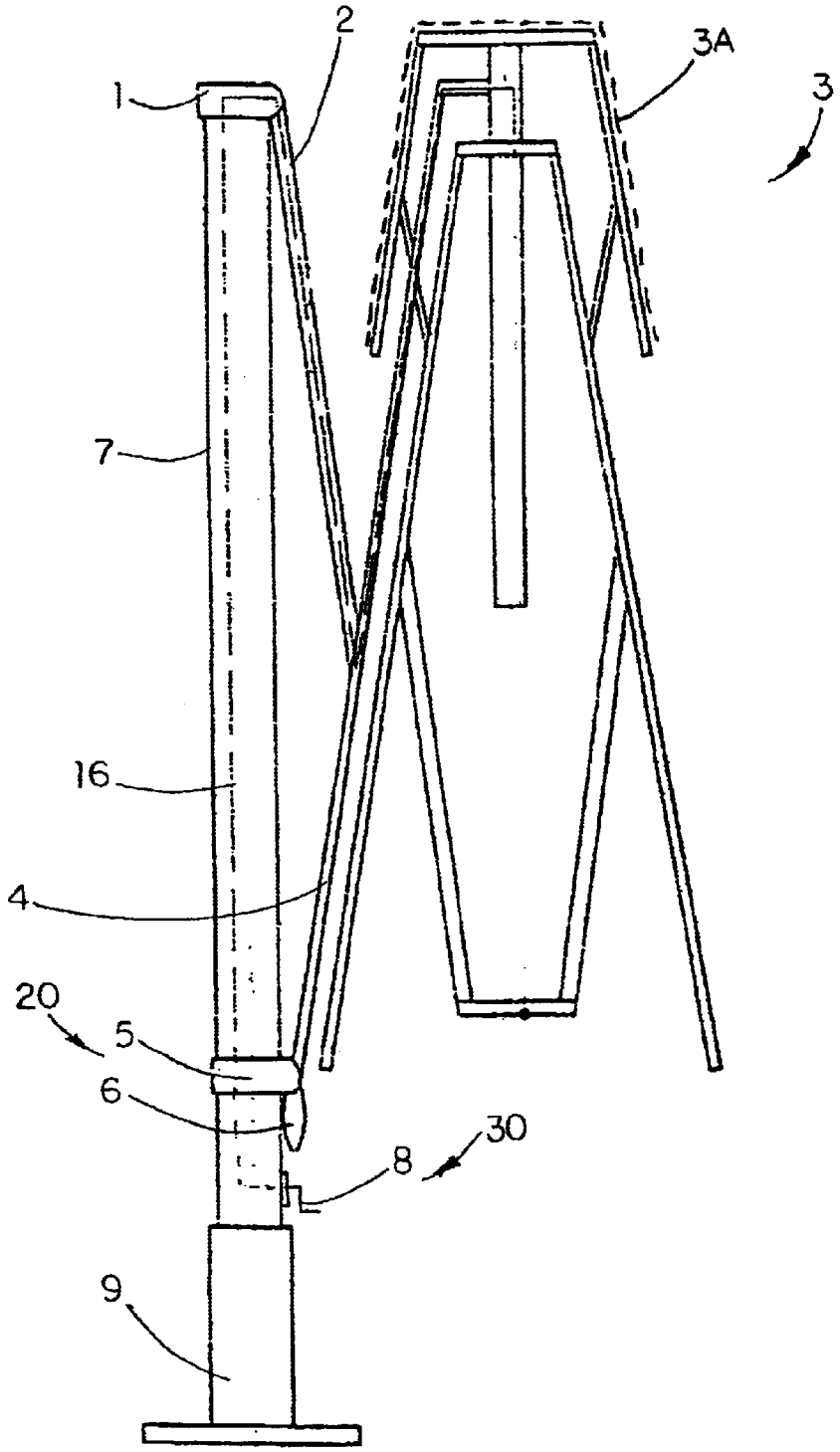
FIG. 1 is a perspective view of an operation device for outdoor umbrella according to a preferred embodiment of the present invention.
Figure 5:
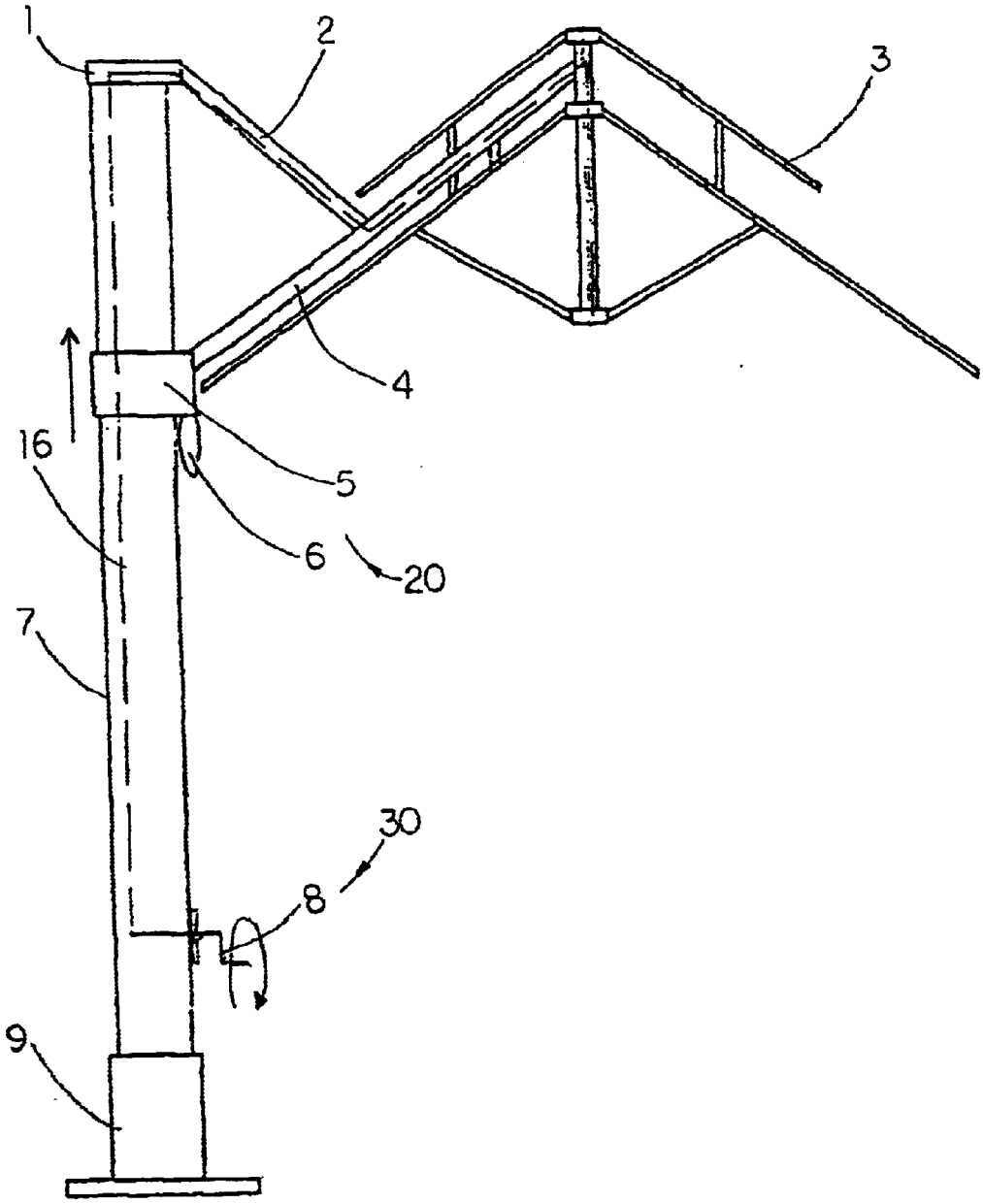
FIG. 5 is a perspective view of the operation device for outdoor umbrella in an unfolded position according to the above preferred embodiment of the present invention.

Referring to FIG. 1 of the drawings, an operation device for outdoor umbrella according to a preferred embodiment of the present invention is illustrated, wherein the outdoor umbrella, such as a conventional outdoor umbrella, comprises a stand 9, a rotatable shaft 7 uprightly extended from the stand 9 wherein a locker hole 71 is transversely provided on an outer surface of the shaft 7, a foldable awning frame 3 supported a fabric 3A thereon comprising a first supporting arm 2 extended to a top 1 of the shaft 7 and a second supporting arm 4 pivotally connected to the first supporting arm 2 and arranged in such a manner that when the second supporting arm 4 pivotally rotates toward to the first supporting arm 2, the foldable awning frame 3 is unfoldably extending, as shown in FIG. 5.

Figure 2:
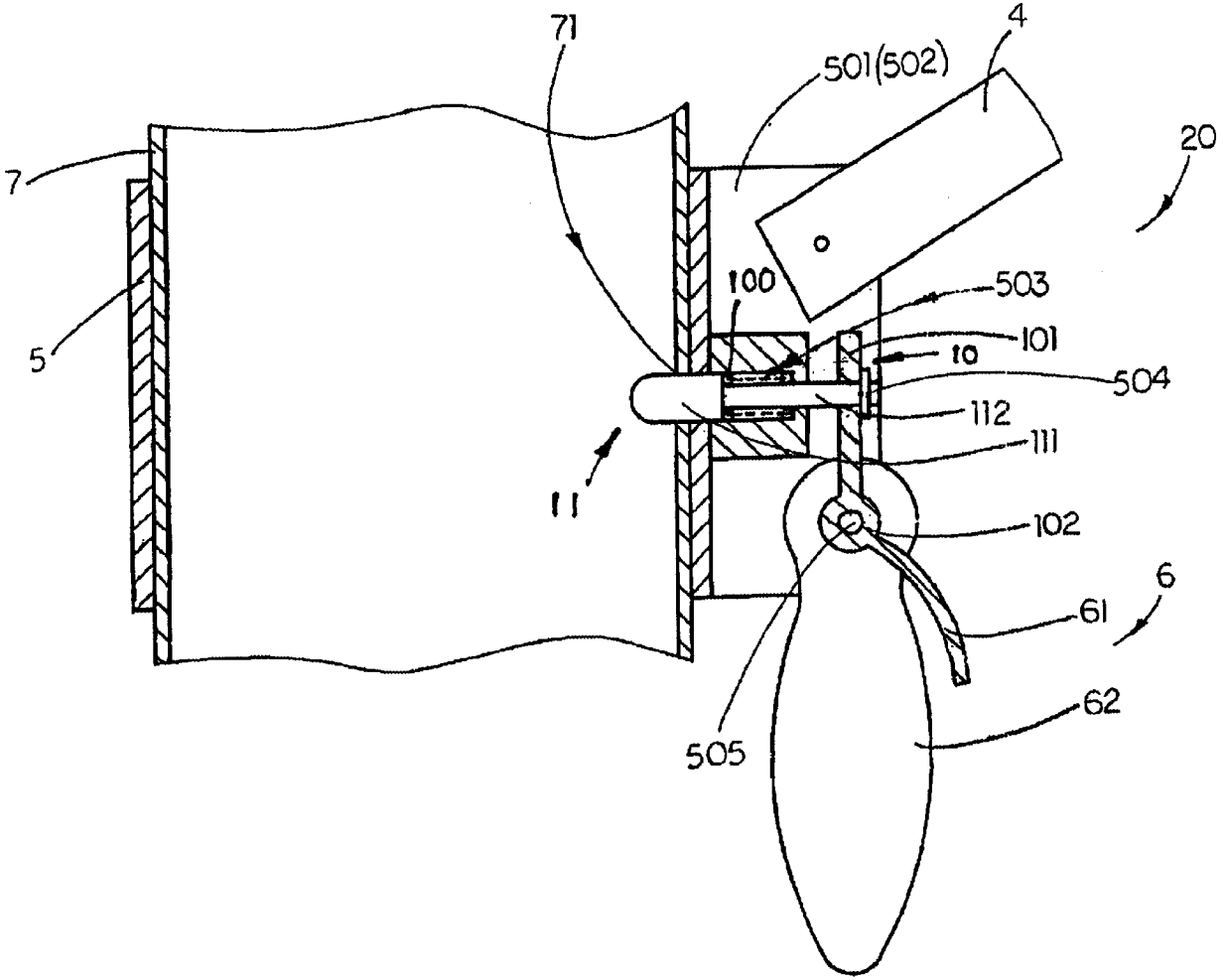
FIG. 2 is a side sectional view of the operation device for outdoor umbrella according to the above preferred embodiment of the present invention.
Figure 3:
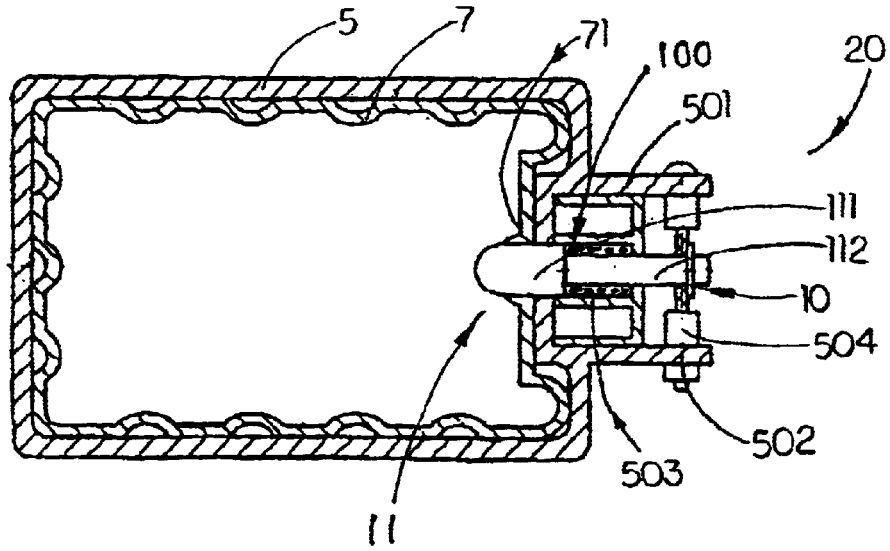
FIG. 3 is a top sectional view of the operation device for outdoor umbrella according to the above preferred embodiment of the present invention.

As shown in FIGS. 2 and 3, the outdoor umbrella further comprises a pulley system 30 mounted on a lower portion of the shaft 7 for folding and unfolding the fabric 3A and an operation device 20.

The operation device 20 comprises a tubular slider joint 5 slidably mounted on the shaft 7 in a vertical movable manner wherein the second supporting arm 4 of the foldable awning frame 3 is pivotally connected to the slider joint 5 a locking stopper 11 fitted in the locker hole 71 of the shaft 7 in an inwardly movable manner, means 10 for applying an urging pressure against the locking stopper 11 to normally urge and retain the locking stopper 11 extending into the locker hole 71 so as to lock up the slider joint 5 on the shaft 7, and a handle means 6 for driving the locking stopper 11 in an outwardly movable manner to move away from the locker hole 71 so as to unlock the slider joint 5 from the shaft 7, wherein the means 10 comprises a resilient unit 10 having a resilient element 100 which is disposed in the guiding slot 503 and has one end coupled with said locking stopper 11 while another end thereof biased against a bottom wall of the guiding slot 503.

According to the preferred embodiment, the slider joint 5 comprise a pair of parallel walls 501, 502 integrally and outwardly extended therefrom wherein a guiding slot 503 is defined between the two parallel walls 501, 502 in such a manner that the locking stopper 11 is slidably received in the guiding slot 503 in a horizontal movable manner.

The locking stopper 11, which is supported between the two parallel walls 501, 502, has an enlarged head portion 111 having a shape and size adapted for fittedly inserting into the locker hole 71 of the shaft 7 and an elongated tail portion 112 rotatably mounted on an axle 504 which is perpendicularly mounted between the two parallel walls 501, 502. Normally, when the head portion 11 of the locking stopper 11 fits in the locker hole 71, the slider joint 5 is positioned in a locking condition, that is blocked the sliding movement of the slider joint 5 on the shaft 7, so as to lock up the awning frame 3 in an unfolded position.

As shown in FIG. 2, the resilient unit 10 is an elastic blade having a driving end 101 affixed to the tail portion 112 of the locking stopper 11 and a pivot end 102 pivotally mounted on an axis 505 which is perpendicularly mounted between the two parallel walls 501, 502 wherein the driving end 101 of the resilient unit 10 is normally urged and retained the locking stopper 11 in the locking condition, i.e. pushing the locking stopper 11 in an inwardly movable manner.

The handle means 6 comprises a curved operation handle 61 integrally extended from the pivot end 102 of the resilient unit 10 and a holding handle 62 affixed to the pivot end 102 of the resilient unit 10 in such a manner that when the operation handle 61 is pressed towards the holding handle 62, the operation handle 61 is arranged to pivotally bend the driving end 101 of the resilient unit 10 outwardly, so as to move the head portion 111 of the locking stopper 11 away from the locker hole 71, which is an unlocked condition of the slider joint 5.

Figure 4:
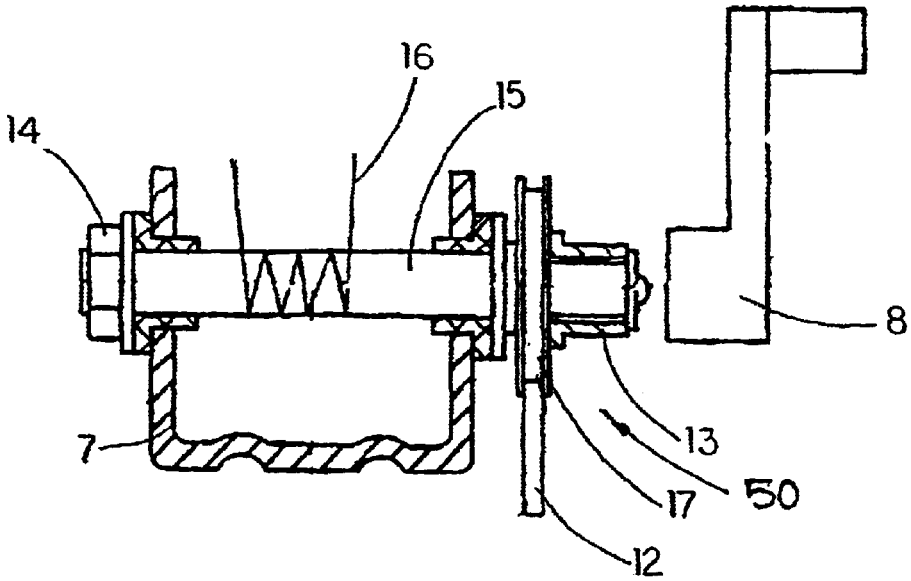
FIG. 4 is a sectional view of a pulley system of the outdoor umbrella according to the above preferred embodiment of the present invention.

Referring to FIG. 4, the pulley system 30 comprises a pulley shaft 15 perpendicularly mounted on the shaft 7 in a rotatably movable manner, a lift cord 16 having a predetermined length extended from the pulley shaft 15 to the awning frame 3 through the shaft 7, a hand bar 8 arranged to drive the pulley shaft 15 to rotate in such a manner that the lift cord 16 is wound on the pulley shaft 15 so as to unfoldably extend the fabric 3A, and a lift lock 50 comprising a locking rotor 17 coaxially mounted on the pulley shaft 15 and a locking claw 12 pivotally connected to the locking rotor 17 and arranged to securely engage with the locking rotor 17 so as to lock up the rotation of the pulley shaft 15.

The pulley system 30 further comprises an affixing locker 14 and a driven locker 13 securely mounted at two ends of the pulley shaft 15 so as to hold the pulley shaft 15 on the shaft 7 in position wherein the hand bar 8 is detachably mounted on the driven locker 13 having a hexagonal shape so as to drive the pulley shaft 15 to rotate.

In order to unfold the outdoor umbrella as shown in FIG. 5, an upward pushing force must be intentionally applied on the slider joint 5 wherein the second supporting arm 4 of the awning frame 3 is arranged to pivotally rotate towards to the first supporting arm 2 so as to pivotally extend the awning frame 3. The slider joint 5 is upwardly slidably on the shaft 7 until the locking stopper 11 is aligned with the locker hole 71 on the shaft 7. Due to the urging pressure of the resilient element 100, the locking stopper 11 is forced to insert into the locker hole 71 so as to lock up the slider joint 5 on the shaft 7.

For unlock the operation device 20, a compression force must be intentionally applied on the operation handle 61 so as to move the locking stopper 11 away from the locker hole 71. Therefore, the slider joint 5 is adapted for freely sliding along the shaft 7.

Once the outdoor umbrella is in the unfolded position, a user is able to extend the fabric 3A by operating the pulley system 30. The user simply attaches the hand bar 8 to the driven locker 13 and drives the pulley shaft 15 in a rotating manner to wind up the lift cord 16 so as to extend the fabric 3A.

In accordance with the preferred embodiment as disclosed above, the operation device and the pulley system are individually provided on the outdoor umbrella of the present invention so that the user does not have to manipulate both the operation device and the pulley system at the same time, which is a hassle for the user. Thus, the extending force of the awning frame will not be applied on the lift cord of the pulley system so as to prolong the service life span of the outdoor umbrella.

What is claimed is:

1. An outdoor umbrella, comprising:

a stand, a rotatable shaft uprightly extended from said stand wherein a locker hole is transversely provided on an outer surface of said shaft, a foldable awning frame which supports a fabric thereon comprising a first supporting arm extended to a top of said shaft and a second supporting arm pivotally connected to said first supporting arm and arranged in such a manner that when said second supporting arm pivotally rotates toward to said first supporting arm, said foldable awning frame extends unfoldably;

a pulley system mounted on said shaft for folding and unfolding said fabric; and an operation device comprising a tubular slider joint slidably mounted on said shaft in a vertical movable manner wherein said second supporting arm of said foldable awning frame is pivotally connected to said slider joint, a locking stopper fitted in said locker hole of said shaft in an inwardly movable manner, means for applying an urging pressure against said locking stopper to normally urge and retain said locking stopper extending into said locker hole so as to lock up said slider joint on said shaft, and a handle means for driving said locking stopper, in an outwardly movable manner, to move away from said locker hole so as to unlock said slider joint from said shaft, wherein said slider joint comprises a pair of parallel walls integrally and outwardly extended therefrom wherein a guiding slot is defined between said two parallel walls in such a manner that said locking stopper is slidably received in said guiding slot in a horizontal movable manner, wherein said means comprises a resilient unit having a resilient element which is disposed in said guiding slot and has one end coupled with said locking stopper while another end thereof biased against a bottom wall of said guiding slot, wherein said locking stopper has an enlarged head portion having a shape and size adapted to fittedly insert into said locker hole of said shaft and an elongated tail portion which is extended between said two parallel walls, wherein said resilient unit has a driving end urging against said locking stopper and an opposed end which is pivotally mounted to said two parallel walls, wherein said handle means comprises a curved operation handle integrally extended from said opposed end of said resilient element wherein said operation handle is arranged to pivotally drive said driving end of said resilient unit to bend outwardly, so as to move said head portion of said locking stopper away from said locker hole.

2. The outdoor umbrella, as recited in claim 1, wherein said handle means further comprises a holding handle affixed to said opposed end of said resilient element such that when said operation handle is pressed towards said holding handle, said head portion of said resilient element is moved away from said locker hole.

3. The outdoor umbrella, as recited in claim 2, wherein said pulley system comprises a pulley shaft perpendicularly mounted on said shaft in a rotatably movable manner, a lift cord having a predetermined length extended from said pulley shaft to said awning frame through said shaft, a hand bar arranged to drive said pulley shaft to rotate in such a manner that said lift cord is wound on said pulley shaft so as to unfoldably extend said fabric, and a lift lock comprising a locking rotor coaxially mounted on said pulley shaft and a locking claw pivotally connected to said locking rotor and arranged to securely engage with said locking rotor so as to lock up a rotation of said pulley shaft.

4. The outdoor umbrella, as recited in claim 3, wherein said pulley system further comprises an affixing locker and a driven locker securely mounted at two ends of said pulley shaft so as to hold said pulley shaft on said shaft in position wherein said hand bar is detachably mounted on said driven locker to drive said pulley shaft to rotate.

5. The outdoor umbrella, as recited in claim 4, wherein said hand bar having a shape and size adapted for fittedly mounting to said driven locker having a hexagonal shape.

6.The outdoor umbrella, as recited in claim 1, wherein said pulley system comprises a pulley shaft perpendicularly mounted on said shaft in a rotatably movable manner, a lift cord having a predetermined length extended from said pulley shaft to said awning frame through said shaft, a hand bar arranged to drive said pulley shaft to rotate in such a manner that said lift cord is wound on said pulley shaft so as to unfoldably extend said fabric, and a lift lock comprising a locking rotor coaxially mounted on said pulley shaft and a locking claw pivotally connected to said locking rotor and arranged to securely engage with said locking rotor so as to lock up a rotation of said pulley shaft.

7. The outdoor umbrella, as recited in claim 6, wherein said pulley system further comprises an affixing locker and a driven locker securely mounted at two ends of said pulley shaft so as to hold said pulley shaft on said shaft in position wherein said hand bar is detachably mounted on said driven locker to drive said pulley shaft to rotate.

8. The outdoor umbrella, as recited in claim 7, wherein said hand bar having a shape and size adapted for fittedly mounting to said driven locker having a hexagonal shape.

9. An outdoor umbrella, comprising:

a stand, a rotatable shaft uprightly extended from said stand wherein a locker hole is transversely provided on an outer surface of said shaft, a foldable awning frame which supports a fabric thereon comprising a first supporting arm extended to a top of said shaft and a second supporting arm pivotally connected to said first supporting arm and arranged in such a manner that when said second supporting arm pivotally rotates toward to said first supporting arm, said foldable awning frame extends unfoldably;

a pulley system mounted on said shaft for folding and unfolding said fabric; and an operation device comprising a tubular slider joint slidably mounted on said shaft in a vertical movable manner wherein said second supporting arm of said foldable awning frame is pivotally connected to said slider joint, a locking stopper fitted in said locker hole of said shaft in an inwardly movable manner, means for applying an urging pressure against said locking stopper to normally urge and retain said locking stopper extending into said locker hole so as to lock up said slider joint on said shaft, and a handle means for driving said locking stopper, in an outwardly movable manner, to move away from said locker hole so as to unlock said slider joint from said shaft, wherein said slider joint comprises a pair of parallel walls integrally and outwardly extended therefrom wherein a guiding slot is defined between said two parallel walls in such a manner that said locking stopper is slidably received in said guiding slot in a horizontal movable manner, wherein said means comprises a resilient unit having a resilient element which is disposed in said guiding slot and has one end coupled with said locking stopper while another end thereof biased against a bottom wall of said guiding slot, wherein said resilient unit has a driving end urging against said locking stopper and an opposed end which is pivotally mounted to said two parallel walls, wherein said handle means comprises a curved operation handle integrally extended from said opposed end of said resilient element wherein said operation handle is arranged to pivotally drive said driving end of said resilient unit to bend outwardly, so as to move said head portion of said locking stopper away from said locker hole, wherein said handle means further comprises a holding handle affixed to said opposed end of said resilient unit such that when said operation handle is pressed towards said holding handle, a head portion of said resilient element is moved away from said locker hole.

* * * * *